United States Patent [19]

Pierce

[11] 4,337,569

[45] Jul. 6, 1982

[54] METHOD OF MAKING INTEGRALLY FORMED TRANSFORMER COOLING DUCTS

[75] Inventor: Linden W. Pierce, Rome, Ga.

[73] Assignee: General Electric Company, N.Y.

[21] Appl. No.: 99,450

[22] Filed: Dec. 3, 1979

Related U.S. Application Data

[63] Continuation of Ser. No. 881,216, Feb. 27, 1978, abandoned.

[51] Int. Cl.[3] ..... H01F 41/06

[52] U.S. Cl. ..... 29/605; 336/60

[58] Field of Search ..... 29/605, 602 R; 336/60; 72/146, 147, 402

[56] References Cited

U.S. PATENT DOCUMENTS

| | | | |
|---|---|---|---|
| 3,200,357 | 8/1965 | Olsen et al. | 29/605 X |
| 3,341,941 | 9/1967 | Olsen | 29/605 X |
| 3,789,337 | 1/1974 | Sheppard | 336/60 |

FOREIGN PATENT DOCUMENTS

| | | | |
|---|---|---|---|
| 2430035 | 8/1976 | Fed. Rep. of Germany | 336/60 |

*Primary Examiner*—Carl E. Hall

*Attorney, Agent, or Firm*—Robert A. Cahill

[57] ABSTRACT

A vaporization cooled transformer is provided with rectangular windings in which the cooling ducts are integrally formed by pressing the coils with a hydraulic press. The coils are smaller than windings in which cooling channels are formed by insulating spacers. The smaller windings result in a savings in conductor material, core material, fluid, and tank plate.

1 Claim, 12 Drawing Figures

METHOD OF MAKING INTEGRALLY FORMED TRANSFORMER COOLING DUCTS

This is a continuation of application Ser. No. 881,216, filed Feb. 27, 1978 now abandoned.

BACKGROUND OF THE INVENTION

Transformers using mineral oil as a dielectric and coolant generally employ windings in which cooling channels are maintained in the windings by the use of ribs to space the winding layers apart. The coolant is caused to flow by natural convection through the channels to cool the winding. The fluid is cooled by an external heat exchanger and the cool fluid is returned to the bottom of the channel. The heat transfer within the winding is determined by the flow rate and boundary layer thickness and is influenced predominantly by the fluid density and viscosity. The channel thickness ranges from 0.188 minimum to about 0.50 inch. The channel width is determined by the short circuit forces which must be resisted by the coil conductor and ranges from about 1 inch to 3 inches. Transformers are also constructed utilizing air or gas as a coolant with duct thickness of 0.375 minimum with 0.50 inch normally used. The natural convection heat transfer is also dependent upon any obstructions in the coolant channel which might occur in the winding manufacture. Because of these obstructions such as layer insulation, crooked spacers, etc., duct sizes below the minimum determined from experience are not used. Since the state of the art of providing cooling ducts for windings for mineral oil transformers is well established manufacturers have also utilized the same geometries for vaporization cooled transformers. FIG. 1 shows a prior art winding described within U.S. patent application Ser. No. 843,676 entitled "Percolation Cooled Electrical Transformers". A rectangular winding 10 is provided with rectangular cooling duct 11 approximately 3/16 inch wide by 1½ inches long, formed by inserting rectangular spacers 12 into the winding during manufacture.

FIGS. 2 and 3 show the prior art method of manufacturing the cooling channel spacers 12. Rectangular strips of pressboard 12' are glued to a thin sheet of paper 13 which is inserted between the winding layers during winding. On round windings the paper strip 13 may be omitted and the strips 12' are inserted into the winding during the coil winding process and held in place by the pressure exerted by the wire due to the tension applied during the winding. The strips 12' may also be made of round fiber rods or other shapes or materials to maintain the coolant duct size. Some manufacturers use a cooling duct 11 formed by means of a thick corrugated paper board 14 as shown in FIG. 4.

The use of coolant ducts 11 for example as described in the prior art is undesirable for vaporization cooled transformer windings because the method increases the radial dimensions ("build") of the winding and the length of the wire required. The additional length of wire increases the winding resistance and resulting electrical losses which may be dissipated by the condenser. The condenser size must therefore be larger than if a smaller winding with lower losses could be used. The losses may be reduced by increasing the conductor cross-section area, but this results in an increased quantity of conductor material and core steel. In addition, a smaller radial build further reduces the tank size and the quantity of fluid required. There is also labor involved in the manufacture of the cooling ducts and their insertion into the winding. The paper sheets to which the strips are attached increases the temperature of the winding which must be compensated for by increases in the conductor or condenser sizes. With a decreased radial build of the winding, therefore, less core steel, conductor material, tank, liquid and condenser surface area are required so that substantial reductions in transformer weight and cost can be realized.

It is an object of this invention to reduce the radial build of vaporization cooled transformer windings by means of a novel method of integrally forming reduced size coolant ducts without the use of rectangular strips, ribs and corrugated boards as commonly used in transformer manufacture.

SUMMARY OF THE INVENTION

Efficient coolant channels of a minimum size are integrally provided within two sides of a rectangular vaporization cooled transformer winding by pressing the adjacent two sides in a hydraulic press. The method substantially reduces the radial build of the winding resulting in a decrease in both the weight and cost of the transformer.

DESCRIPTION OF THE PREFERRED EMBODIMENT

Figure 5:
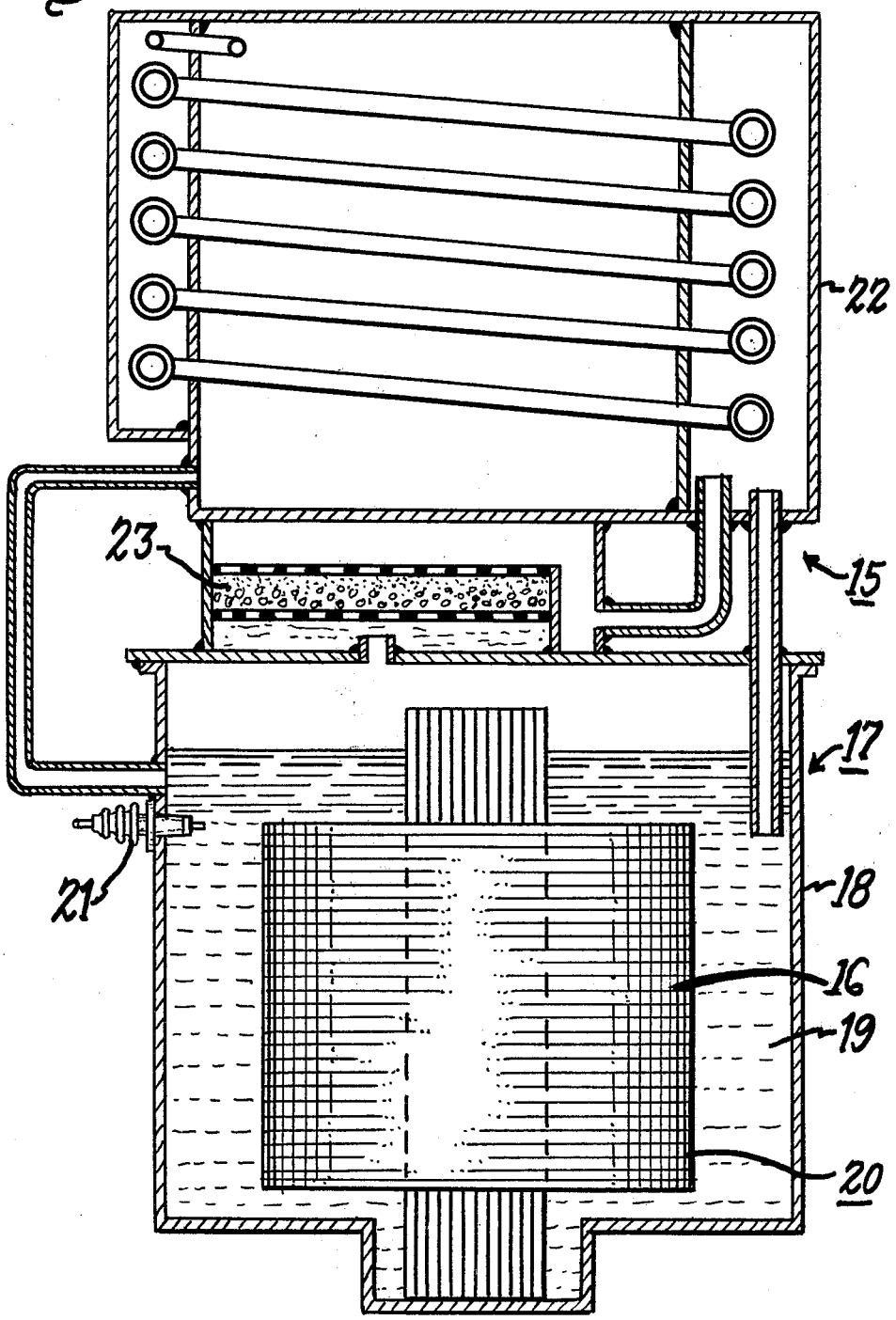
FIG. 5 is a front sectional view of a transformer assembly using the improved winding of the invention.

FIG. 5 shows a transformer cooling apparatus 15 employing the novel windings 16 of the invention. The apparatus 15 includes a boiler 17 consisting of a tank 18 containing a coolant 19 and a transformer 20. Electrical feed-through bushing 21 is provided on one side of the tank 18 for electrical connection with transformer 20. A heat exchanger 22 is mounted on the top of the tank 18 to condense the vapor of coolant 19 and return it to the tank 18. A suitable heat exchanger 22 is more fully described in U.S. patent application Ser. No. 862,352 entitled "Improved Heat Exchanger for Vaporization Cooled Transformer". A molecular sieve 23 may be employed to remove impurities from the vapor of coolant 19. The use of a molecular sieve absorbent in the vapor stream of a condensable coolant is more fully described in the aforementioned U.S. patent application Ser. No. 843,676 filed Oct. 19, 1977 entitled "Percolation Cooled Electrical Transformers" incorporated herein by way of reference.

Figure 6:
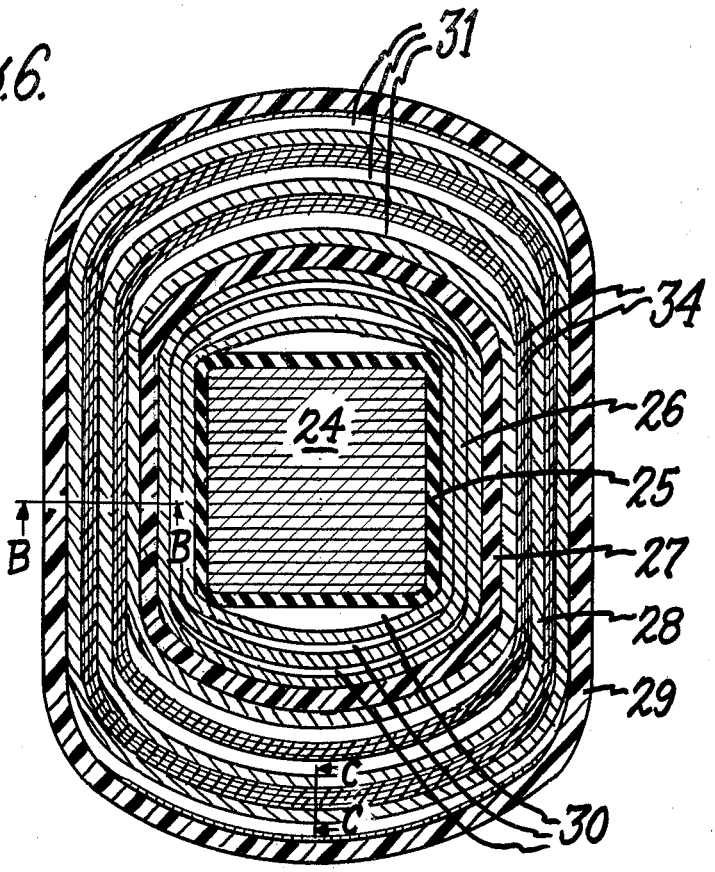
FIG. 6 is a top sectional view of a transformer winding of the invention.

The reduced radial build windings 16 of this invention are shown in greater detail in FIG. 6 wherein a rectangular core 24 supports a plurality of windings 16 consisting of inner rectangular cylinder 25, secondary winding 26, inner insulating wrapping 27, primary winding 28 and outer insulating wrapping 29. Secondary winding 26 contains cooling gaps 30 and primary winding 28 contains cooling gaps 31 as shown. Cooling gaps 30 and 31 are a minimum size and are formed by a novel process to be described below. The inner rectangular cylinder 25 provides electrical insulation from the core 24 to the secondary winding 26 and also serves to support the windings 16 during manufacture and prior to installation upon core 24. Inner insulation wrapping 27 provides electrical insulation from the secondary winding 26 to the primary winding 28. Outer insulating wrapping 29 provides insulation from the primary winding 28 to the tank 18. For some voltage ratings the coolant 19 provides sufficient electrial insulation to the tank 18 and the outer wrapping 29 may be omitted.

Figure 7:
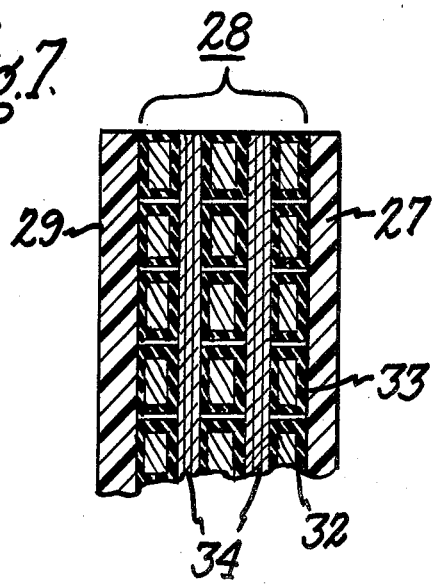
FIG. 7 is a section view along the line B—B of FIG. 6.

The primary winding 28 is shown in greater detail in FIG. 7 which is a section view along the line B—B of FIG. 6. The primary winding 28 consists of a finite number of strands of conductor 33. The insulation between strands of conductor 33 is provided by strand insulation 32 which may be a film coating or paper wrapping on the conductor 33. A number of strands are wound one above the other in the vertical direction to form a layer. Electrical insulation between layers is provided by layer insulation 34 consisting of one or more pieces of paper as is common in the manufacture of transformers. For some type windings the strand insulation 32 may be omitted and the strands 33 connected to form one turn per layer. Alternately, the conductor strands 33 may consist of a sheet of conductor strip or foil consisting of one strip per layer. The conductor material is commonly copper or aluminum.

Figure 1:
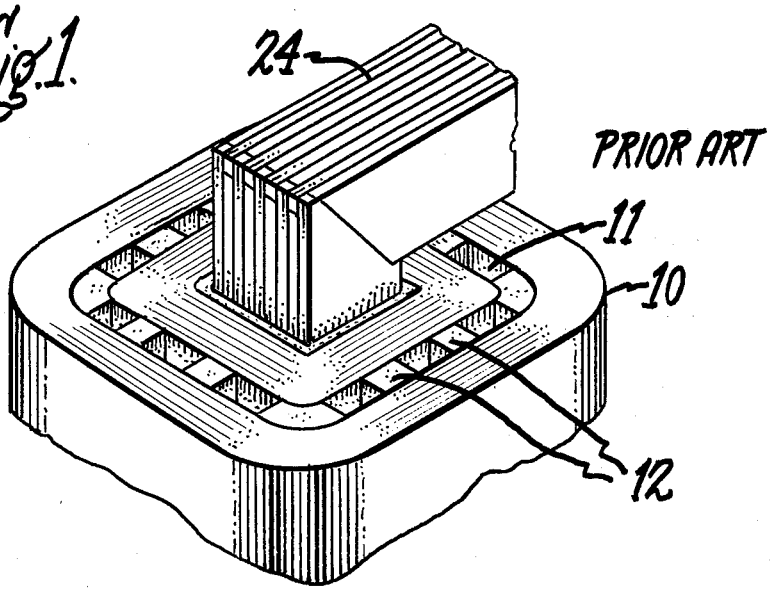
FIG. 1 is a top perspective view of a transformer winding of the prior art.
Figure 2:
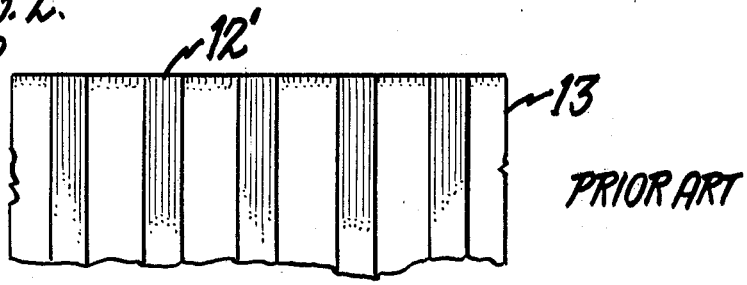
FIG. 2 is a plan view of one prior art cooling duct assembly.
Figure 3:
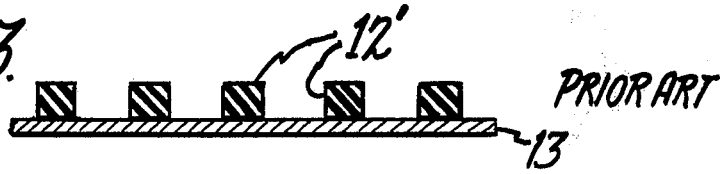
FIG. 3 is a side view of the cooling duct assembly of FIG. 2.
Figure 4:
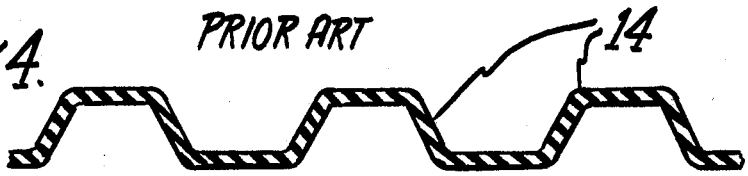
FIG. 4 is a plan view of an alternate prior art cooling duct assembly.
Figure 8:
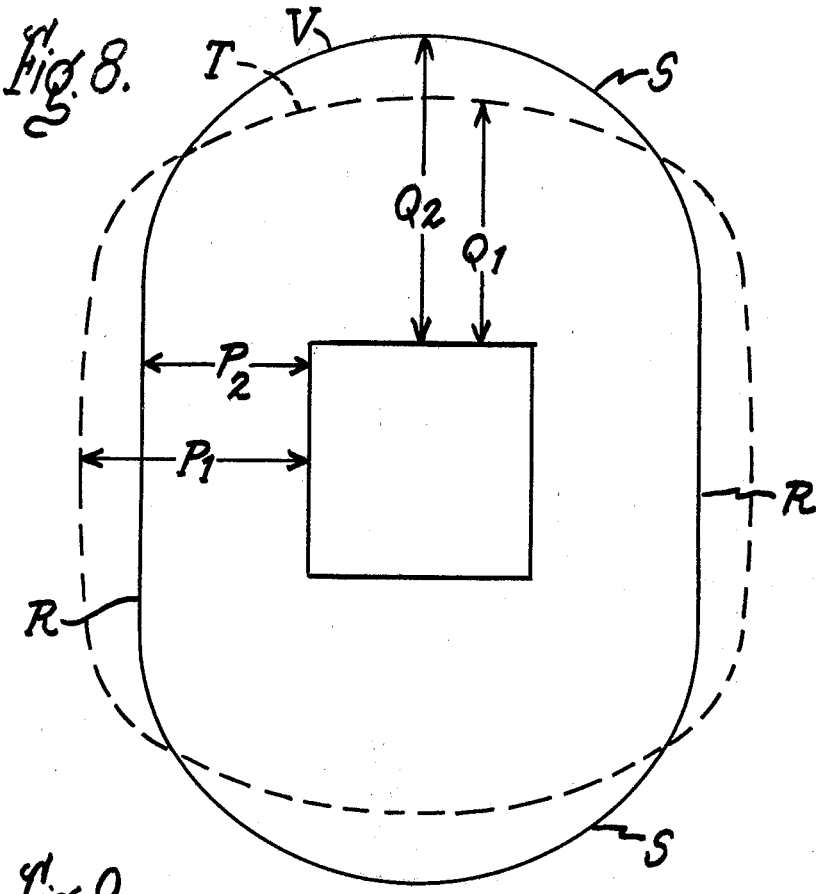
FIG. 8 is an illustration of the formation of cooling gaps in accordance with this invention.

Now, it has been discovered that the large cooling channels 11 formed by rectangular strips 12 in the prior device of FIG. 1 may be omitted and small cooling gaps 30 and 31 (FIG. 6) of adequate size may be formed by pressing the windings 16 along two opposite sides. FIG. 8 shows windings 16 before and after the pressing operation. The original shape prior to pressing is indicated by the dotted line. The dimensions $P_1$ and $Q_1$ are a sum of the thickness of the strands 33 (FIG. 8) and the strand insulation 32, inner rectangular cylinder 25, layer insulation 34, inner insulating wrapping 27, outer insulating wrapping 29, plus a stacking allowance. The stacking allowance is about 20 percent of the total thickness of the insulation materials in the windings 16. This allowance is due to the looseness in the winding occurring from stacking many layers of conductor and insulation.

Now if a steel or wood block is placed inside the windings 16 to substitute for the core 24 and flat steel plate is placed next to the sides R and the windings 16 are pressed inward such as with a hydraulic press, then the dimension $P_1$ can be reduced to $P_2$ which is less than $P_1$ by the amount of the stacking allowance. The sides S of the windings 16 flare outward and the dimension $Q_1$ increases to $Q_2$.

The operation as described above is used in prior art devices of the type containing large cooling channels 11 formed by rectangular strips 12 as shown in FIG. 1 for compacting the windings by decreasing the stacking allowance to some degree.

I have discovered, however, that the large cooling channels 11 formed by the spacers 12 may be omitted on vaporization cooled transformers. The pressing of the windings 16 along sides R and the movement of sides S from their original position T to their final position V forms gaps next to the conductor strands 33 of a quantity and size sufficient to cool the windings 16. Where prior art oil cooled transformers require cooling channels 11 of 0.188 or 0.250 inch width, it is believed that channels on the order of only 0.020 to 0.050 inch are required for vapor cooled transformers due to the low surface tension and thus the good wetting properties of the vaporizable fluids used, such as trichlorotrifluroethane. In mineral oil immersed transformers, the cooling mode in the winding is natural convection and is influenced predominantly by the viscosity of the oil thereby requiring large cooling channels.

It is known that in small transformer windings of ratings of about 5 kVA and of a size of 3 to 4 inches, no cooling ducts need be provided if the conductor is of sufficient size. In large power transformers with a rating up to 2500 kVA cooling channels formed from rectangular strips must be provided.

Figure 9:
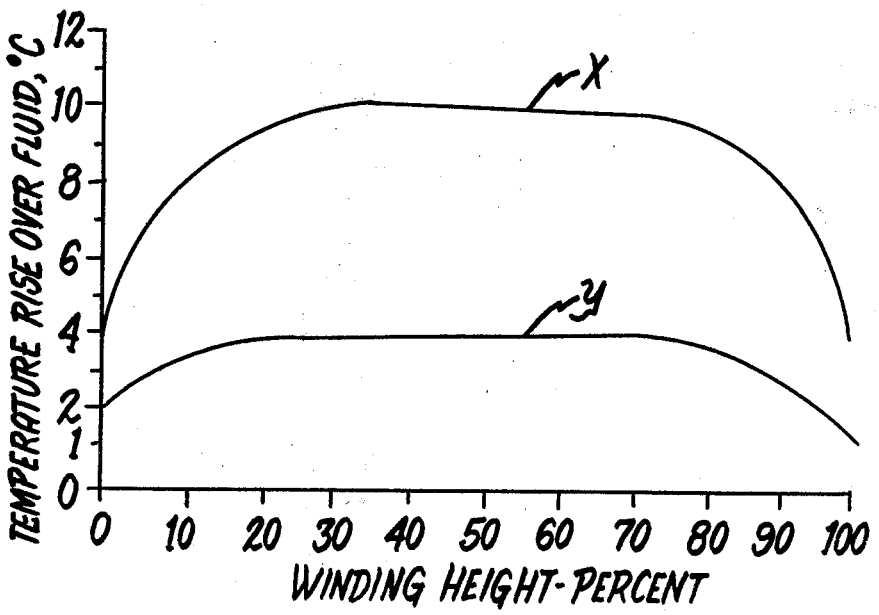
FIG. 9 is graphic representation of the improvement in winding temperature obtained by this invention.

FIG. 9 shows the temperature profile in a transformer winding constructed in accordance with principles of this invention. The coolant 19 (FIGS. 5 and 6) enters the bottom of the cooling gaps 31 and flows upward. A portion of the coolant 19 is vaporized and cools the conductor strands 33 next to the cooling gaps 31. Coolant 19 also contacts the top and bottom of the windings and is vaporized and cools the conductor strands 33 at the top and bottom of the winding 18. Curve Y (FIG. 9) shows the vertical temperature profile along section C—C of FIG. 6 for the conductor strands 33 next to a cooling gap 31. Curve X shows the vertical temperature profile along section B—B of FIG. 6 for the conductor strands 33 in the pressed section of the winding where no cooling gaps 31 are present. The temperature profile Y is less than the temperature profile X indicating the effectiveness of the cooling gaps 31. The conductor strands 33 along section B—B are cooled by thermal conduction vertically to the cooler strands 33 at the top and bottom of the winding 16. The maximum temperature along Curve X is reduced considerably from the maximum temperature that would result if no cooling gaps 31 were provided. For a particular winding the maximum temperature rise without cooling gaps 33 would be 196° C. With cooling gaps 33, as provided by my invention, the maximum temperature rise is about 10° C.

The location of the cooling gaps 30 and 31 occur in a somewhat random manner so that the accuracy of the prediction of the temperature rise is on the order of 30 percent. The temperature rises which result, however, are well below the thermal capability of the insulations used. That is, the maximum temperature rise may vary from 7° to 13° C. when the required rise is 33° C. The temperature rise may, of course, be changed by changing the cross section area of the strand but in general when the required electrical losses and impedance are met the maximum temperature rise is well below required limits and with a smaller radial build and less material than used prior to my discovery.

Figure 12:
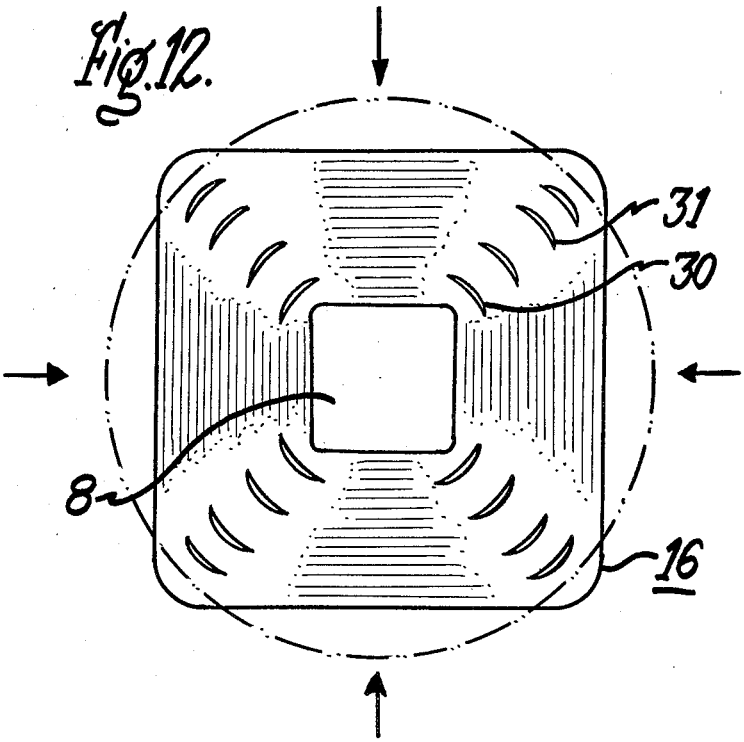
FIG. 12 is an illustration of an alternate formation of the transformer winding of the invention.

One method for accurately forming cooling gaps 30 and 31 can be seen by referring to FIG. 12 where an original quasi-circular winding 16 is isotatically pressed in the directions indicated by arrows. After pressing, winding 16 assumes the quasi-rectangular configuration indicated at 16. Cooling gaps 30 and 31 result in a direction radially outward from the core opening 8.

Figure 10:
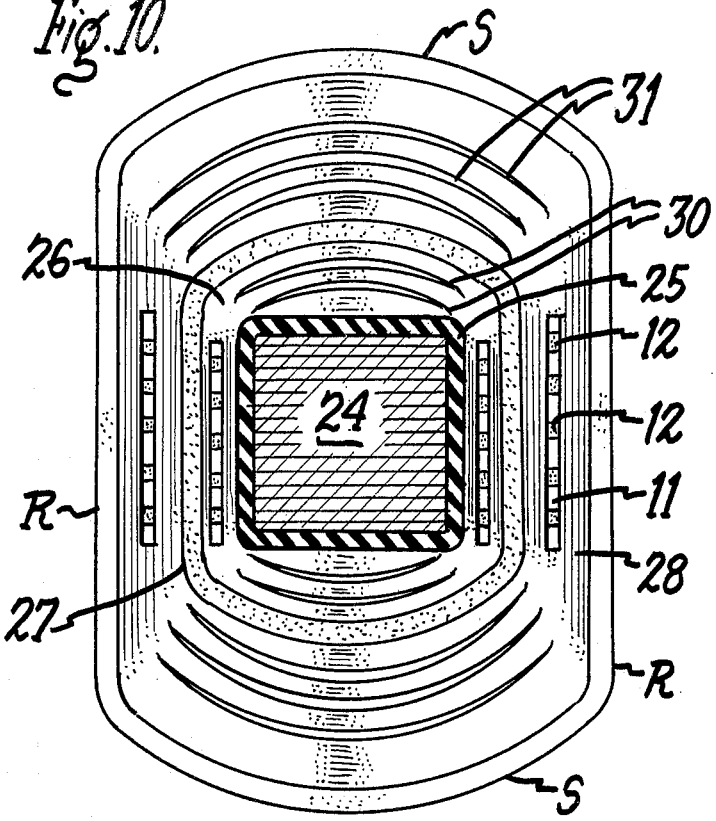
FIG. 10 is a top sectional view of the winding design according to this invention.
Figure 11:
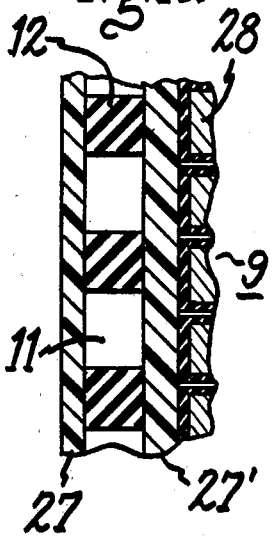
FIG. 11 is a side view of a further cooling duct assembly.

When vaporization cooling is employed within transformers having larger ratings than the embodiments of FIG. 5, for example, the maximum temperature rise of profile X may exceed the permissible rise. This temperature rise may be decreased by adding one or more prior art cooling ducts 11 to the pressed sides R of the winding 16 as shown in FIG. 10. Spacer strips 12 are inserted to form the cooling ducts 11 in the pressed sides R by the methods of the prior art. The width of the strips 12 may be reduced from the sizes used in the prior art to about 0.06 inches. No cooling ducts 11 of the prior art design should be required in the unpressed sides S. However, ducts 11 may be inserted at locations where natural cooling gaps 30 or 31 do not occur in order to prevent localized heating. The number of cooling ducts 11 is reduced by the method of the instant invention and a smaller radial build winding results.

Inner insulating wrapping 27 may be replaced with a combined insulation-duct assembly 9 consisting of wrapping 27 auxillary wrappings 27' having spacers 12 and ducts 11 for improved electrical insulation or to obtain the desired impedance. This structure is known to those skilled in the art of electrical winding design.

Although the embodiment of FIG. 6 describes the primary winding 28 and secondary winding 26 pressed together at one time, it should be clearly understood that both the primary winding 28 and secondary winding 26 may be pressed individually without departing from the scope of the invention.

It should also be apparent that one of the windings (28,26) may be of an alternate construction as known to those skilled in the art of electrical winding design.

The preferred embodiment describes a two-winding transformer in which the primary winding 28 is wound over the secondary winding 26. This is referred to as the "S-P construction". An alternate design consists of splitting the secondary winding 26 into two parts and winding the second part of the secondary winding 26 over the primary 28. This is referred to as the "S-P-S construction". The two secondary parts are connected externally to the winding. The instant invention may therefore be applied to any number of windings wherein internal cooling ducts may be required.

Although the improved winding of the invention is described for use with vaporization cooled transformers, this is by way of example only. The improved winding may be used in other type electrical apparatus such as reactors or cryogenic electromagnets in which layer type electrical coils are cooled by a vaporizable coolant.

I claim:

1. A method for forming a transformer winding having integral cooling ducts comprising the steps of:

providing a plurality of layers of transformer wires around a rectangular core opening to define a quasi-rectangular transformer winding having first and second pairs of opposing sides;

inserting a plurality of spacers between said wire layers on said first pair of said opposing sides of said winding to define first cooling ducts for the transport of vaporizable coolant; and applying pressure to said first pair of said opposing sides to take up the stacking allowance thereat and cause said second pair of opposing sides to elongate, whereby to create separations of said wire layers proximate said second pair of sides, said separations defining second cooling ducts for the transport of vaporizable coolant through said windings, at least said second cooling ducts having a range in thickness from about 0.20 to 0.50 inches.

* * * * *